United States Patent [19]

Mangler et al.

[11] Patent Number: 4,958,453

[45] Date of Patent: Sep. 25, 1990

[54] MULTIDOCUMENT HOLDER WITH ARTICULATING LINE GUIDE

[75] Inventors: Robert J. Mangler, Chicago; Anne J. Marsland, Schaumburg; George O. Podd, Chicago; Russell Schweizer, Crystal Lake, all of Ill.

[73] Assignee: Wilson Jones Company, Chicago, Ill.

[21] Appl. No.: 346,047

[22] Filed: May 2, 1989

[51] Int. Cl.[5] ..... B41J 11/64

[52] U.S. Cl. ..... 40/352; 40/354; 40/357

[58] Field of Search ..... 40/352, 354, 357; 248/446; 312/231, 233

[56] References Cited

U.S. PATENT DOCUMENTS

| | | | |
|---|---|---|---|
| 795,104 | 7/1905 | Cook | 40/354 |
| 1,984,711 | 12/1934 | van Alstyne | 40/352 |
| 2,198,356 | 4/1940 | Unger et al. | 40/354 |
| 4,455,773 | 6/1984 | Denison | 40/357 |
| 4,882,863 | 11/1989 | Gross | 40/357 |

*Primary Examiner*—Victor N. Sakran

*Attorney, Agent, or Firm*—Pennie & Edmonds

[57] ABSTRACT

A large copyholder for holding stacks of documents of varying thickness having a line guide adjustable to accommodate for stack thickness. The line guide is pivotal to also serve variable thickness stacks adjacent the copyholder. The line guide is connected to the copyholder through a frictional axis arrangement to hold the line guide in selected positions.

9 Claims, 3 Drawing Sheets

MULTIDOCUMENT HOLDER WITH ARTICULATING LINE GUIDE

BACKGROUND OF THE INVENTION

Copyholders having document-support surfaces for accommodating multilayered documents are old: U.S. Pat. No. 2,198,356. Where thick multidocument volumes are involved, a mechanism for adjusting the guide line position so that it can be positioned at varying distances is required.

Devices for holding and viewing documents which are fan-folded or which are added to and removed from the holder in sequential fashion have presented problems not addressed by prior copyholders.

SUMMARY OF THE INVENTION

Broadly, the present invention is an enlarged copyholder comprising a planar body supportable on a support surface and held in viewing position using a stand. The planar body is sized to accommodate a multipage fan-folded document as a stack or in page-by-page sequence from an adjacent second multipage document stack positioned on the support surface. The copyholder includes an adjustable line guide unit which assists in viewing the multipage document or portion thereof, when placed on and supported by the stack on the holder or alternatively when placed on a portion of such multipage document on the support surface. The line guide arm carrying the line guide is mounted so that it is readily capable of articulation to orient it adjacent to and parallel to the top page of either stack.

It is a feature that the line guide is so mounted that it is readily positionable on the top page of the document on the holder or on the top page of the document positioned on the support surface adjacent the stand. As the stack thickness varies the line guide is always capable of being positioned with its surface parallel to the stack surface.

It is also a feature of the invention that the line guide can be readily moved a distance away from either top page to permit pages to conveniently be moved from one stack to the other.

DESCRIPTION OF THE PREFERRED EMBODIMENTS

Figure 1:
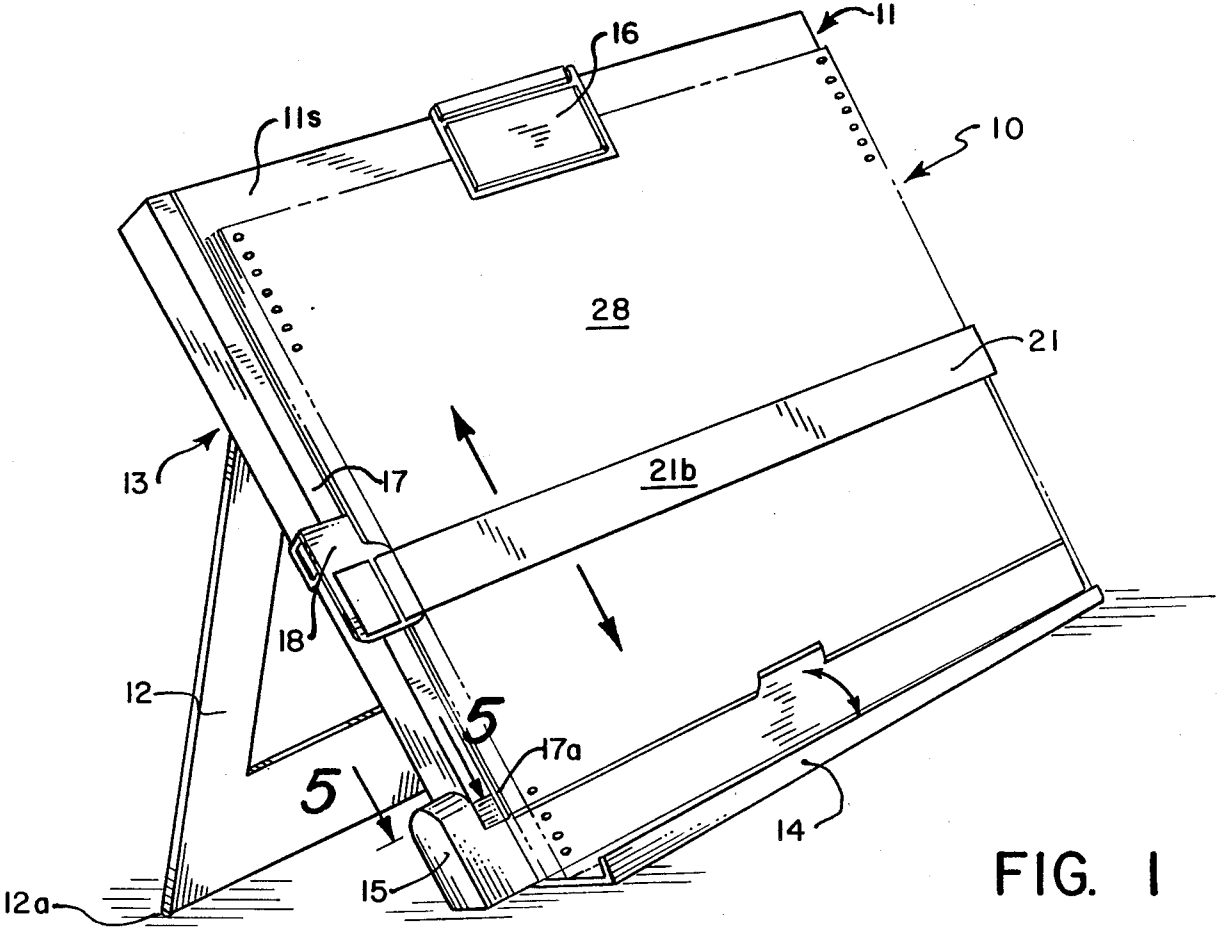
FIG. 1 is a perspective view of the copyholder standing on a support surface including line guide resting on a document stack with sheet spacing exaggerated for illustrative reasons.

In the Figures, copyholder 10 includes holder planar body 11, stand 12 with stand feet 12*a*, pivotable line guide orientation unit 13, foldable stack retaining bar 14 and stack-retaining clip 16. Planar body 11 includes planar surface 11*s* for supporting a stack of papers on other objects to be viewed.

Line guide unit 13 in turn comprises base block 15, articulated arm 17, slide mount piece 18 mounted on arm 17 and line guide 21, having interior line guide planar surface 21*a*, secured to slide piece 18. Block 15 is pivotally mounted on the left hand side panel 11*a* of planar holder body 11 using axis bolt 20 (FIG. 5).

Figure 5:
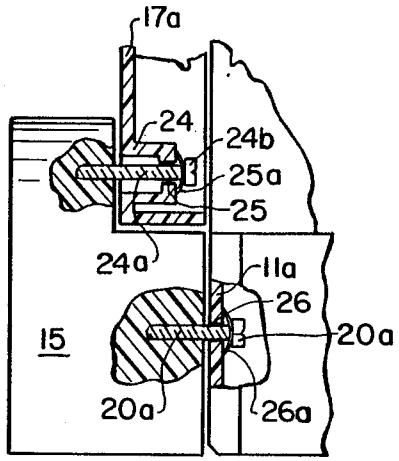
FIG. 5 a sectional view along line 5—5 of FIG. 1.

Block 15 has a cutaway portion 15*a* to accommodate the curved and rounded lower end 17*a* of arm 17 which is pivotably mounted to block 15 using axis bolt 24 (FIG. 5). Bolts 20, 24, having threads 20*a*, 24*a*, fit by way of threaded and frictional engagement tightly in block 15. Bolts 20, 24 engage frictionally in holes 25, 26 in the lower arm end 17*a* and in the body side 11*a* respectively. Washers 25*a*, 26*a* are also used between bolt heads 20*b*, 24*b* and the arm lower end 17*a* and body side 11*a*.

Figure 3:
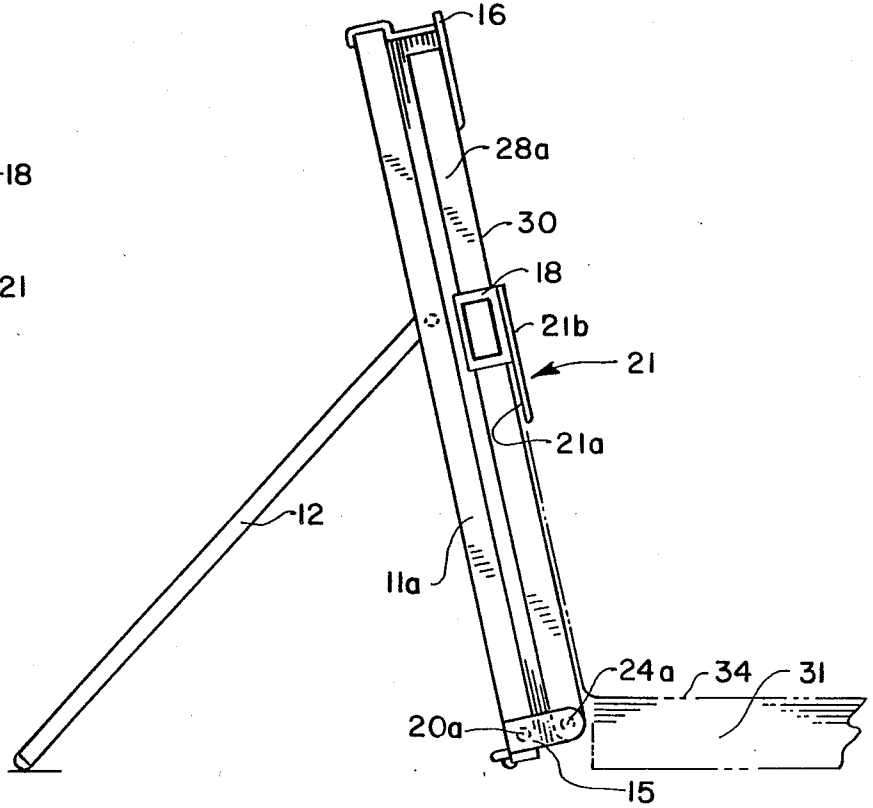
FIG. 3 is a side elevational view with a stack portion on the copyholder with line guide thereon and a stack portion on surface.
Figure 2:
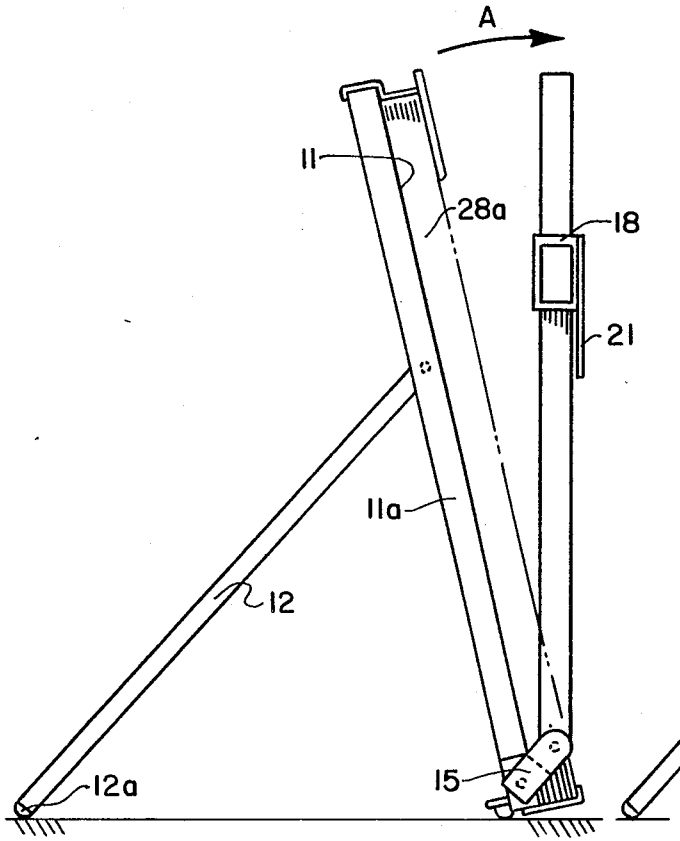
FIG. 2 is a side elevational view of the copyholder with line guide pivoted away from the stack.

Turning in particular to FIGS. 1–3, line guide unit 13 is movable to an infinite number of positions depending on the thickness of the holder stack 28. Due to friction in the system, arm 17 and block 15 tend to stay in the positions they are placed. When line guide unit 13 is in the position of FIG. 1, line guide 21 rests on relatively thin stack 28 preventing arm 17 from pivoting further toward stand 12. In FIG. 2, line guide 21 has been moved to a position in which elongated block 15 is at an angle to planar body to accommodate a thicker stack 28*a* with FIG. 3 showing line guide 21 in its rest position on the top surface of stack 28*a* following movement to that position. Line guide surfaces 21*a*, 21*b* are parallel to the surface 30 of stack 28*a* (FIG. 3).

Where fan-folded printouts are being handled and viewed, a portion 31 of the stack may be placed on the support surface which support surface stack portion 31 is shown in FIG. 3. To move additional sheets from stack portion 31 to stack portion 28*a*, arm 17 is pivoted to the FIG. 2 position and the sheets are moved between line guide 21 and stack 28*a*, for adding to or subtracting from stack 28*a*.

Figure 4:
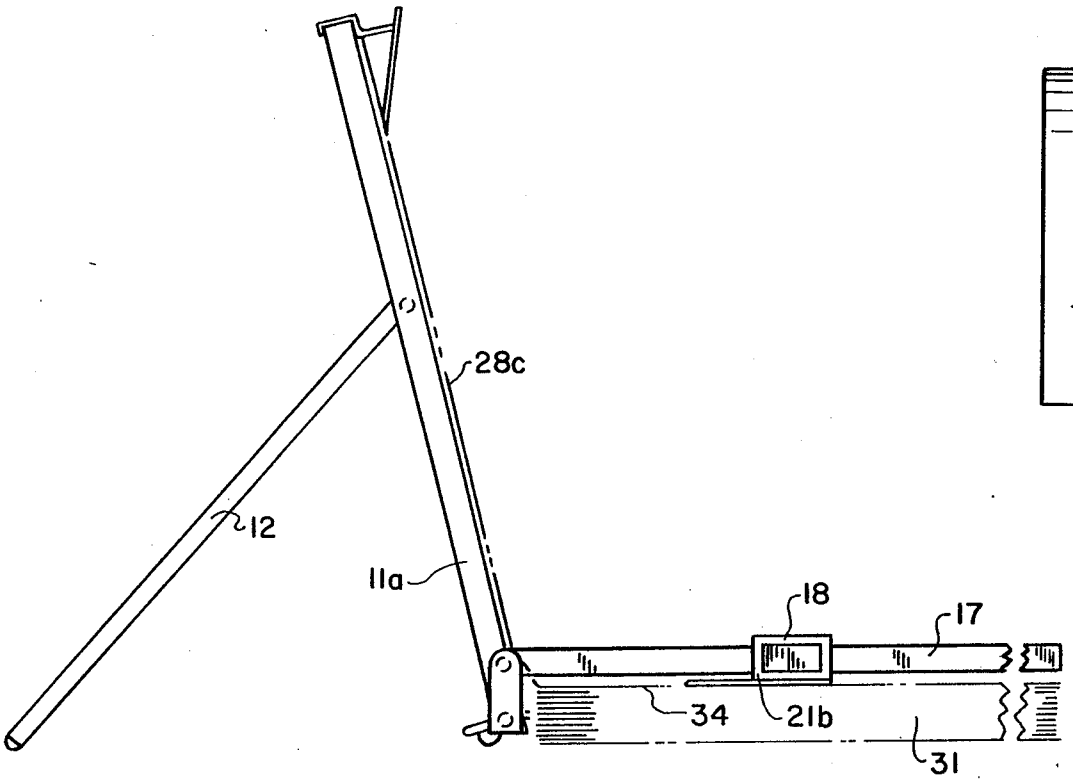
FIG. 4 is a side elevational view with the line guide resting on the stack portion on the support surface.

Finally, line guide unit 21 can be pivoted downwardly until line guide surface 21*b* rests on the top surface 34 of support surface stack where it can be adjusted to assist in reading the sheets of stack 28*a* as positioned in FIG. 4. Only a thin stack 28*c* remains on copyholder 10 as shown in FIG. 4. Stacks 28 and 34 may be composed of single sheets in whole or in part.

I claim:

1. A copyholder having a planar body including a stack holding surface and a body side section, a stand to support the planar body at an angle to a support surface and a pivotable line guide comprising:

a. the stack holding surface sized to hold an object having a top surface;

b. an elongated block means pivotably connected to the body side through pivot means having an axis parallel to the surface of the planar body, such block means having an effective length equal to the maximum thickness of the objects that the holding surface can accommodate;

c. an arm pivotably mounted on the block means for movement in a vertical plan; and d. a line guide including line guide surface slidably connected on the arm for adjustable movement thereon; whereby the elongated block means and the arm can be pivoted to place the line guide surfaces parallel to the top surface of the object.

2. The copyholder of claim 1 in which the object is a stack of objects having a top surface upon which the line guide may rest.

3. The copyholder of claim 1 in which the object is a stack of sheets of paper.

4. The Copyholder of claim 1 in which the block means includes a notched recess and in which the arm has a lower end which end is pivotally connected to the block.

5. The copyholder of claim 4 in which the arm end is curved to assist in its rotation with respect to the block means.

6. The copyholder of claim 1 in which the block means is shaped and proportioned so that the arm is pivotal downwardly onto the top surface of a stack positioned in front of copyholder permits the line guide surface to be oriented parallel to such top surface.

7. The copyholder of claim 1 in which the object is a stack of fan-folded printout sheets.

8. The copyholder of claim 7 in which the arm is pivoted downwardly until one of the line guide surfaces engages a second stack of printout sheets placed adjacent to the copyholder.

9. The copyholder of claim 1 in which the arm and block means are pivotally connected respectively to the block means and the body side through bolt axes frictionally engageable therewith.

* * * * *